US005380220A

United States Patent [19]

Okabe

[11] Patent Number: 5,380,220

[45] Date of Patent: Jan. 10, 1995

[54] CONNECTOR

[75] Inventor: Toshiaki Okabe, Shizuoka, Japan

[73] Assignee: Yazaki Corporation, Tokyo, Japan

[21] Appl. No.: 156,841

[22] Filed: Nov. 24, 1993

[30] Foreign Application Priority Data

Nov. 25, 1992 [JP] Japan ..... 4-336756

[51] Int. Cl.[6] ..... H01R 13/422; H01R 13/58

[52] U.S. Cl. ..... 439/456; 439/460; 439/595

[58] Field of Search ..... 439/456, 459, 460, 595, 439/744

[56] References Cited

U.S. PATENT DOCUMENTS

| | | | |
|---|---|---|---|
| 3,541,229 | 11/1970 | De Smidt | 439/459 |
| 4,029,385 | 6/1977 | Mysiak et al. | 439/595 |
| 4,190,222 | 2/1980 | Appleton et al. | 439/456 |
| 4,220,384 | 9/1980 | Clark et al. | 439/595 |
| 5,073,126 | 12/1991 | Kikuchi et al. | 439/460 |
| 5,149,280 | 9/1992 | Edgeley et al. | 439/456 |

FOREIGN PATENT DOCUMENTS

| | | | |
|---|---|---|---|
| 2854903 | 7/1979 | Germany | 439/459 |
| 415161 | 2/1992 | Japan . | |

*Primary Examiner*—Gary F. Paumen
*Attorney, Agent, or Firm*—Sughrue, Mion, Zinn, Macpeak & Seas

[57] ABSTRACT

A connector in which a wire connected to a press-connecting terminal is positively held without the use of any member attached to an outer side. Openings are formed in a housing adapted to receive press-connecting terminals T each having a wire connected thereto, and holder members for holding the wire in such a manner that the wire is bulged into the opening are formed integrally with the housing.

11 Claims, 7 Drawing Sheets

CONNECTOR

BACKGROUND OF THE INVENTION

1. Field of the Invention

This invention relates to a connector having press-connecting terminals mounted in a connector housing, and more particularly to an improved connector housing, each of said pressing connecting terminals having a press-connecting blade to which an electric wire with a sheath is press-connected electrically.

2. Related Art

In automobiles incorporating electronic devices, not to mention various kinds of electronic equipment, connectors have been extensively used for connecting wires together or for connecting an electronic equipment. Generally, such a connector has terminals mounted in a housing, each of the terminals having an electric wire connected thereto. There is known the type of connector in which the connection between the wire and the terminal is made not by soldering or crimping but by press-connecting.

One example of conventional press-connecting terminal, as well as a conventional connector, will now be described with reference to FIGS. 8 to 11. Referring first to the press-connecting terminal T, an upwardly-open U-shaped slot 1 is formed in a plate portion, formed by stamping and raising part of a bottom portion 6 of the press-connecting terminal T, thereby forming a press-connecting blade 2, as shown in FIGS. 8 and 9. An electric wire 3 shown at the upper side in the drawings is press-fitted into the press-connecting blade 2 as indicated by an arrow. Upon press-fitting of the wire 3, an edge of the press-connecting blade 2 cuts a sheath 4 of the wire 3, thereby electrically connecting a conductor 5 of the wire 3 to the press-connecting blade 2.

However, the press-connecting portion defined by the U-shaped slot 1 is weak against an external pulling force acting on the wire 3, and therefore insulation barrel portions 8 (hereinafter referred merely to "barrel portions") disposed rearwardly of the press-connecting blade 2 are formed by bending portions of the terminal plate, and these barrel portions are pressed around the wire 3 to bear the external pulling force of the wire 3, thereby retaining the press-connected portion, as shown in FIG. 9.

When the wire 3 or a wire harness comprising such wires 3 tied together is to be installed in an automobile or the like, a large external pulling force acts on the wire 3, and unless this external force is borne, an imperfect contact is liable to develop in the press-connected portion. Therefore, the press-connecting terminal T has been mounted in a connector housing 12 (hereinafter referred merely to "housing") as shown in FIGS. 10 and 11.

As best shown in FIG. 11, a wire receiving hole 9 having an open bottom is formed adjacent to a rear end of a terminal receiving chamber 13 of the housing 12, that is, at a right side (indicated by arrow A in FIG. 10) from which the press-connecting terminal T is inserted. Opposed plate-like resilient pieces 15 project respectively from the front rear edges of this bottom opening in a cantilever manner, and these resilient pieces 15 constitute bottom portions of the wire receiving hole 9.

A wire holder member 10 shogun above the housing 12 has a row of wire holder projections 16 formed on a lower surface thereof, the wire holder projections 16 corresponding respectively to the wire receiving holes 9. The wire holder member 10 also has retaining pieces 18 having respective retaining holes 19 in which retaining pawls 17 formed respectively at the opposite sides or ends of the housing 12 are engageable, respectively.

A plurality of interconnected press-connecting terminals T are separated from one another, and are received in the housing 12. The wire 13 is fitted in each terminal receiving chamber 13 as shown in FIG. 11, and the wire holder member 10 is attached to the housing from the upper side to cause each wire holder projection 16 to urge the corresponding wire 3 downwardly, so that the wire 3 is bulged into the wire receiving hole 9 to form a curved or bent wire portion 20.

As a result, the resilient pieces 15 are displaced downwardly by the bent wire portion 20 of the wire 3, and urge the bent wire portion 20 upwardly against the wire holder projection 16 by their resilient force. Namely, the resilient pieces 15 and the wire holder member 10 hold the wire therebetween to bear an external pulling force acting on the wire 3, thus performing a strain relief function.

The above-mentioned housing structure is disclosed in Japanese Utility Model Unexamined Publication No. 4-15161.

In the above housing construction, the wire holder member 10 separate from the housing 12 is needed for bearing an external pulling force acting on the wire 3. Therefore, the number of the component parts is increased, and the number of man-hours to assemble the component parts is increased because the wire holder member 10 must be attached. These contributes to an increased cost.

Since the wire holder member 10 is mounted on the housing 12, the outer size of the housing 12 after such mounting is increased, and besides this is a barrier to a multi-stage construction.

Furthermore, depending on the outer diameter of the wire 3, the wire holder member 10 can not often be attached. When the wire 3 is too small in diameter, the strain relief function is not achieved at all, and thus this construction lacks in versatility.

SUMMARY OF THE INVENTION

It is an object of this invention to provide a connector in which a wire connected to a press-connecting terminal can be positively held without the use of any member attached to the outer side of the connector.

The above object of the invention has been achieved by a connector wherein terminals each having a wire connected thereto are received respectively in receiving chambers formed in a housing; openings are formed in those portions of the housing at which the cables are laid, respectively; and the housing has resilient holder members each of which is resiliently deformed when the wire is pushed in, thereby allowing the wire to bulge into the opening, so that an external pulling force applied to the wire is borne by this bulging.

According to the present invention, there is provided a multi-stage connector comprising: a plurality of terminals each having a wire connected thereto; a housing having a plurality of receiving chambers for receiving the terminals, respectively, the housing including: openings at which the wires are laid; a plurality of resilient holder members for holding the wires, respectively, to allow the wire to bulge into the opening to thereby bear an external pulling force applied to the wires; and a receiving box including a frame in which receiving portion for respectively receiving the housing are formed.

Namely, the wire connected to the press-connecting terminal is held by the resilient holder member, provided on the housing, in such a manner that the wire bulges into the opening formed in the housing. Therefore, the wire is bent in a meandering manner at the position where the opening is provided, and thanks to the holder member, this bent portion will not be straightened. Therefore, even when an external force to withdraw the wire is applied, the wire will not be withdrawn, and an imperfect connection will not develop between the press-connecting terminal and the wire. And besides, the number of the component parts as well as the operation manday can be reduced, and also the connector can be of a compact size.

As described above, according to the present invention, each connector is constructed into a compact size without the use of any member attached to the outer side of the connector. Therefore, an internal space of each receiving portion may be narrow, and the receiving box can also be of a compact size. The multi-stage connector is assembled by inserting the connectors into the respective receiving portions. Since the connector to be thus received is of a compact size, the receiving portion and hence the overall construction of the receiving box can be of a compact size, and therefore it is easily handled.

BRIEF DESCRIPTION OF THE DRAWINGS

FIG. 2 (*b*) and (*c*) cross-sectional views of another embodiments of the present invention;

DETAILED DESCRIPTION OF THE PREFERRED EMBODIMENTS

A first embodiment of the present invention will now be described with reference to FIGS. 1 to 6.

Figure 1:
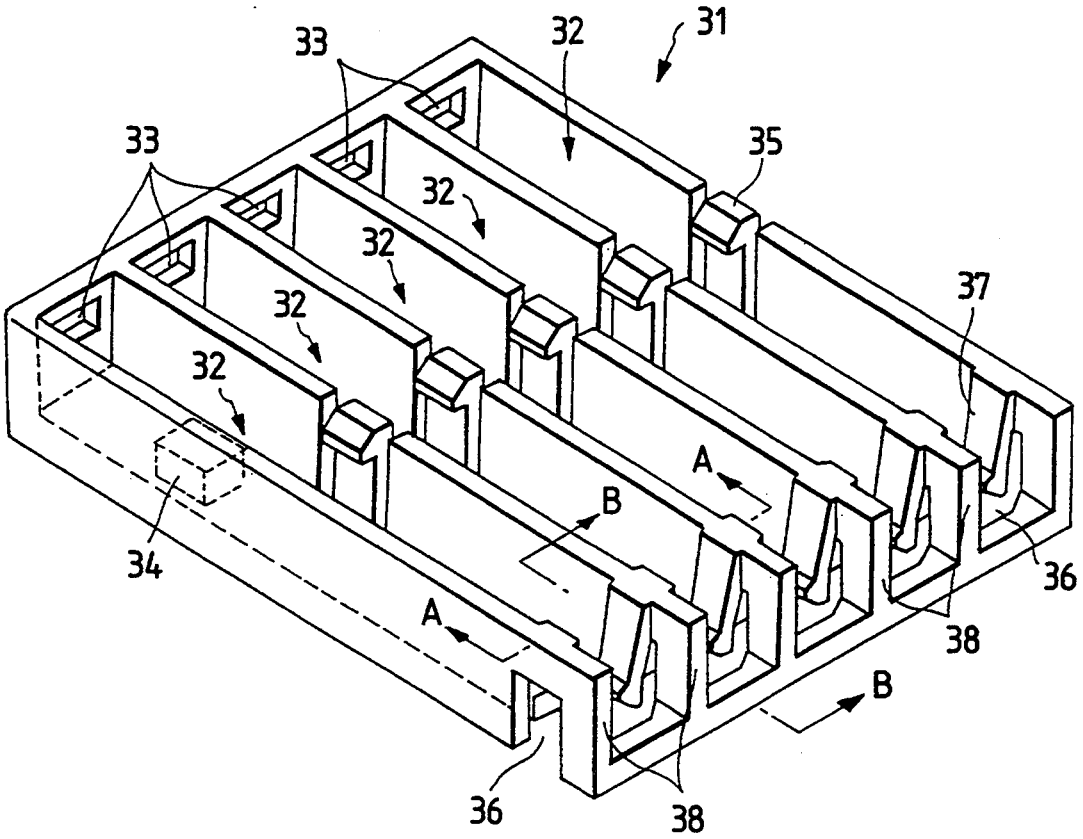
FIG. 1 is a perspective view of a housing, showing a first embodiment of the present invention.
Figure 3:
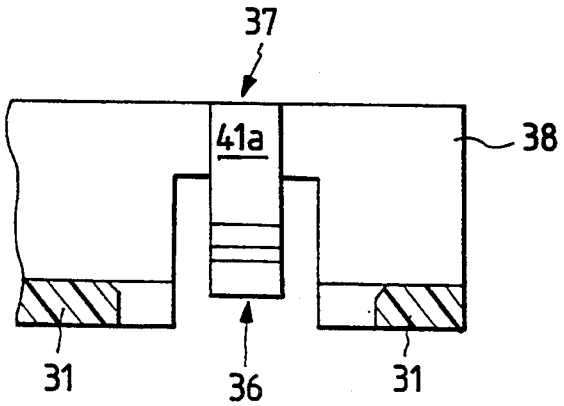
FIG. 3 is a cross-sectional view taken along the line B—B of FIG. 1.
Figure 2A:
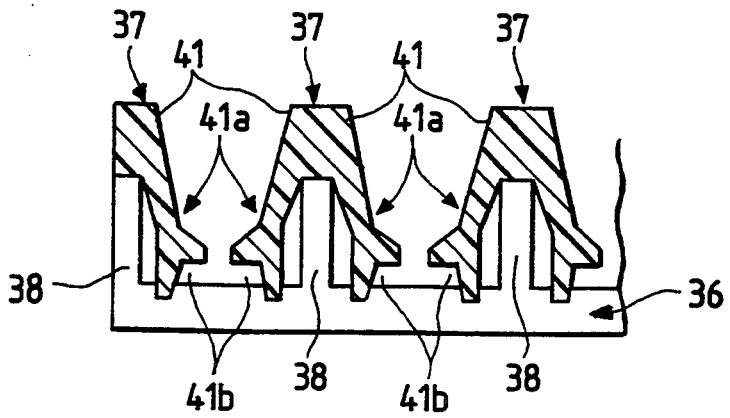
FIG. 2 (*a*) is a cross-sectional view taken along the line A—A of FIG. 1.
Figure 2B:
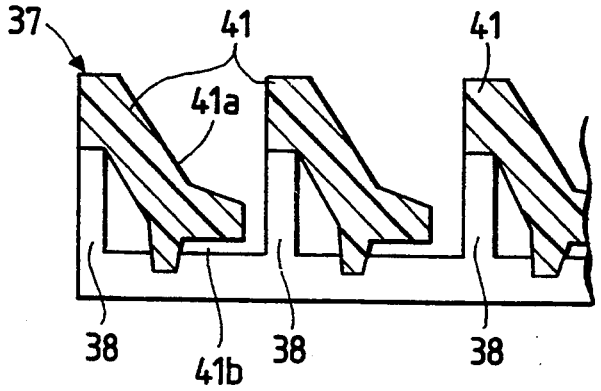
Figure 2C:
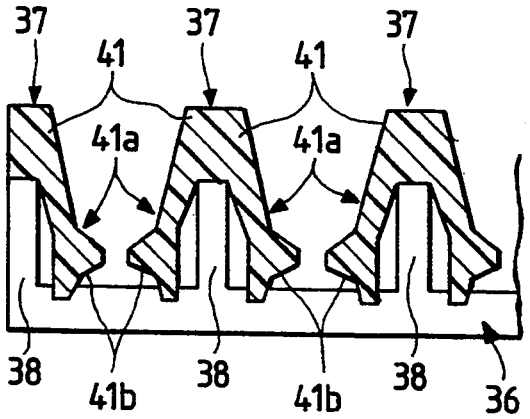
Figure 4:
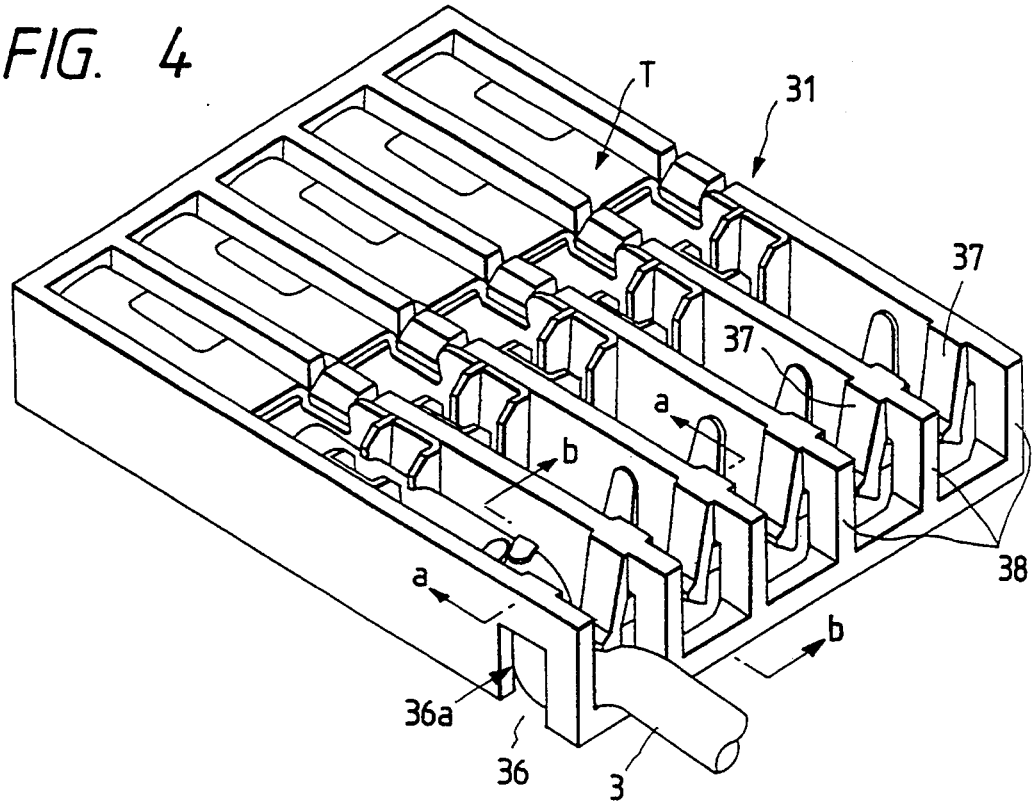
FIG. 4 is a perspective view of a connector in an assembled condition.
Figure 5:
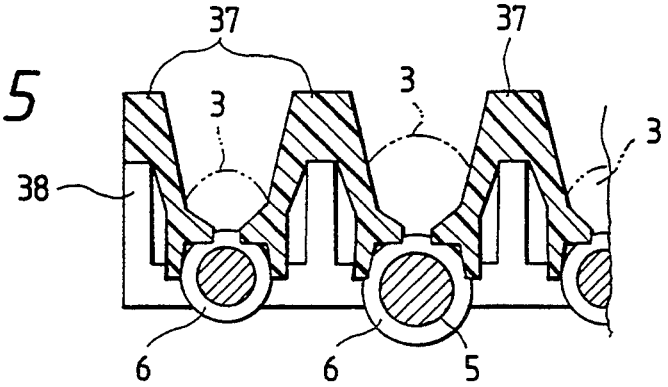
FIG. 5 is a cross-sectional view taken along the line a—a of FIG. 4.
Figure 6:
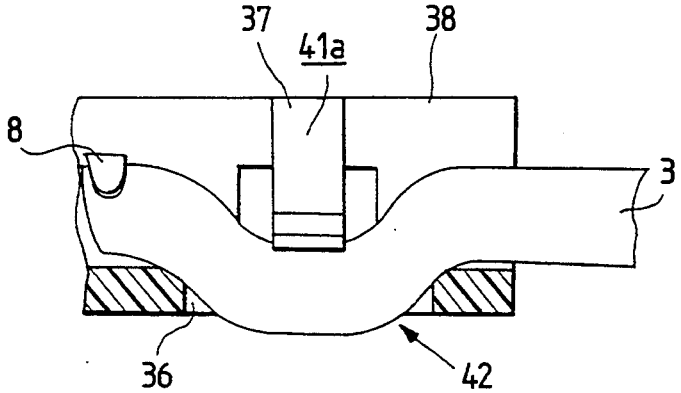
FIG. 6 is a cross-sectional view taken along the line b—b of FIG. 4.

FIG. 1 is a perspective view of a housing, FIG. 2 is a cross-sectional view taken along the line A—A of FIG. 1, FIG. 3 is a cross-sectional view taken along the line B—B of FIG. 1, FIG. 4 is a perspective view of the housing having press-connecting terminals mounted therein; FIG. 5 is a cross-sectional view taken along the line a—a of FIG. 4, and FIG. 6 is a cross-sectional view taken along the line b—b of FIG. 4. The press-connecting terminal T may be of the same construction as that of the conventional one, and therefore explanation of this terminal designated by the same reference character will be omitted.

The housing 31 is of a one-piece molded construction made of a synthetic resin, and has a required number of receiving chambers 32 for receiving the press-connecting terminals T, respectively, each of these receiving chambers being in the form of a longitudinal recess. An insertion hole 33 for allowing a male terminal (not shown) of a connector to be inserted into an external connection portion 7 of the press-connecting terminal T is formed through a front side of each receiving chamber 32. A withdrawal prevention projection 34 for preventing withdrawal of the press-connecting terminal T is formed on a bottom of each receiving chamber 32 as indicated in a broken line.

A resilient member 35 for retaining the press-connecting terminal T, that is, for preventing this terminal from being raised, is provided at a central portion of each receiving chamber 32. With respect to the configuration of this resilient member 35, a flange is formed on and projects from one side of a plate at an upper end thereof, this plate being resiliently bent right and left. An opening 36 is formed through the bottom of each receiving chamber 32 at a rear end portion thereof (lower side in FIG. 1), and a holder member 37 for relieving a strain on an electric wire 3 is provided in generally facing relation to each opening 36.

The opening 36 and the holder member 37 will now be described with reference to FIGS. 2 and 3. The openings 36 are formed across the respective receiving chambers 32, and are in communication with one another. The holder member 37 includes umbrella-like resilient pieces 41 which extend from a partition wall 38, separating the receiving chambers 32 from each other, in such a manner that the resilient pieces 41 close part of the opening 36. An upper portion of the resilient piece 41 has a slanting surface 41*a* for allowing the wire 3 to move downward, and a lower portion thereof has a step portion 41*b* for holding the wire 3.

When the wire 3 is pushed from the upper side, each resilient piece 41 is deformed inwardly, so that the wire 3 slides over a projected edge from the slanting surface 41*a* to be received in the step portion 41*b* whereupon the resilient piece 41 is returned by its own resiliency to a configuration indicated in a solid line in FIG. 2, thereby preventing the wire 3 from being withdrawn upwardly.

Next, the strain relief function for the wire 3 will now be described with reference to FIGS. 4 to 6.

The press-connecting terminals T are separately received in the receiving chambers 32, respectively, as shown in FIG. 4. At this time, the wire 3 urges the opposed resilient pieces 41 away from each other, and is received by the step portions 41*b*. Upon reception of the wire 3 by the step portions 41*b*, the resilient pieces 41 once deformed are returned to their initial configuration, and therefore the resilient pieces close the wire 3, with a slight gap formed therebetween at the upper portion of the wire 3, as shown in FIG. 5.

The wire 3 is bulged into the opening 36 by the resilient pieces 41, and this portion is curved in a meandering manner to provide a bent wire portion 42, as shown in FIG. 6. Therefore, even when the wire 3 is pulled by an external force, the wire 3 will not be withdrawn from the press-connecting terminal T, and any particular care does not need to be taken when installing the wire.

Thus, in the housing 31 of this embodiment, the wire 3 is held by the holder members 37 formed integrally with the housing 31, and therefore the separate member described above for the prior art is not necessary. Therefore, the number of the component parts, as well as the operation manday, can be reduced, and a reduced cost and a compact construction can be achieved.

Figure 7:
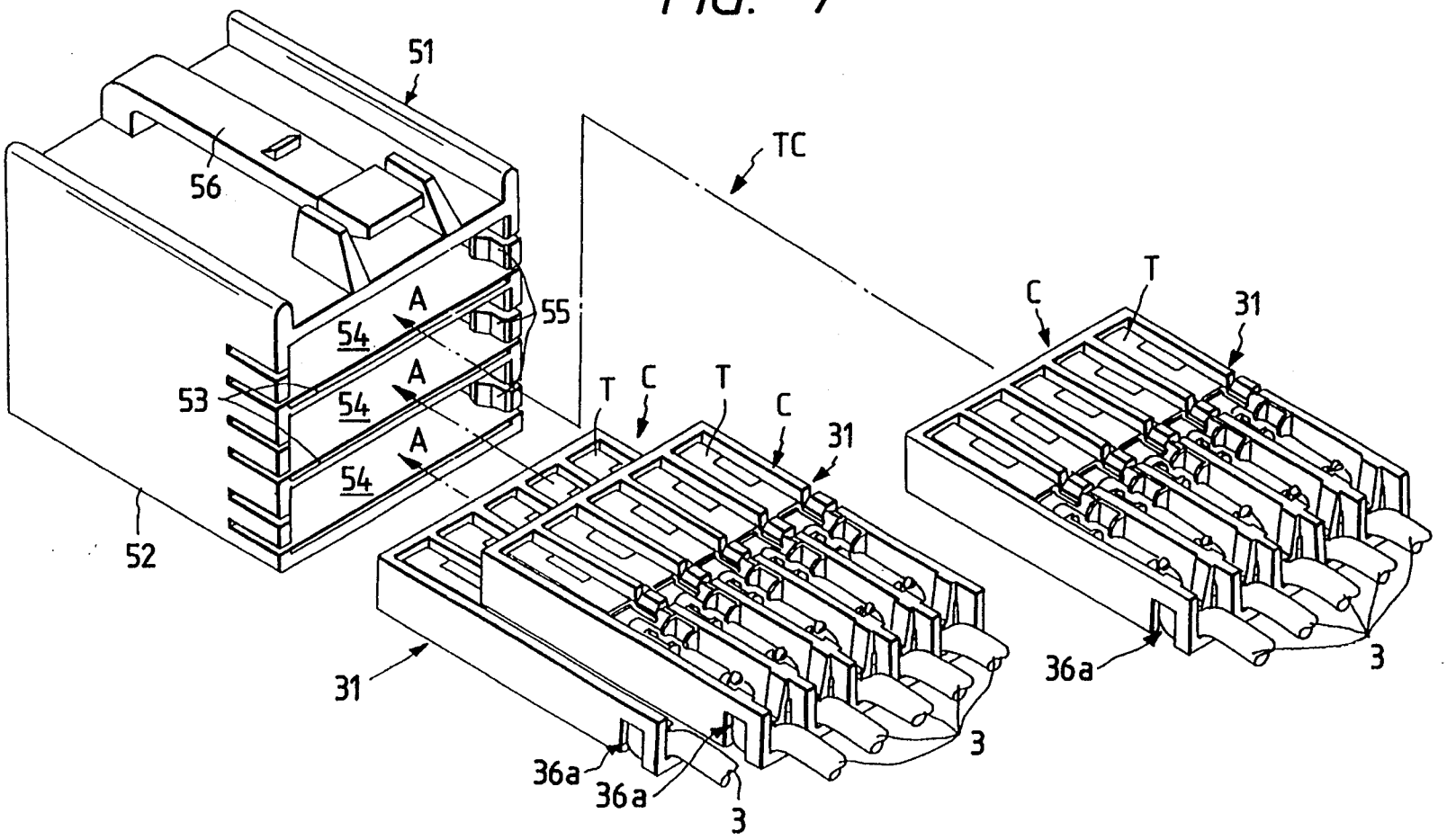
FIG. 7 is a perspective view of a multi-stage connector, showing a second embodiment of the present invention.
Figure 8:
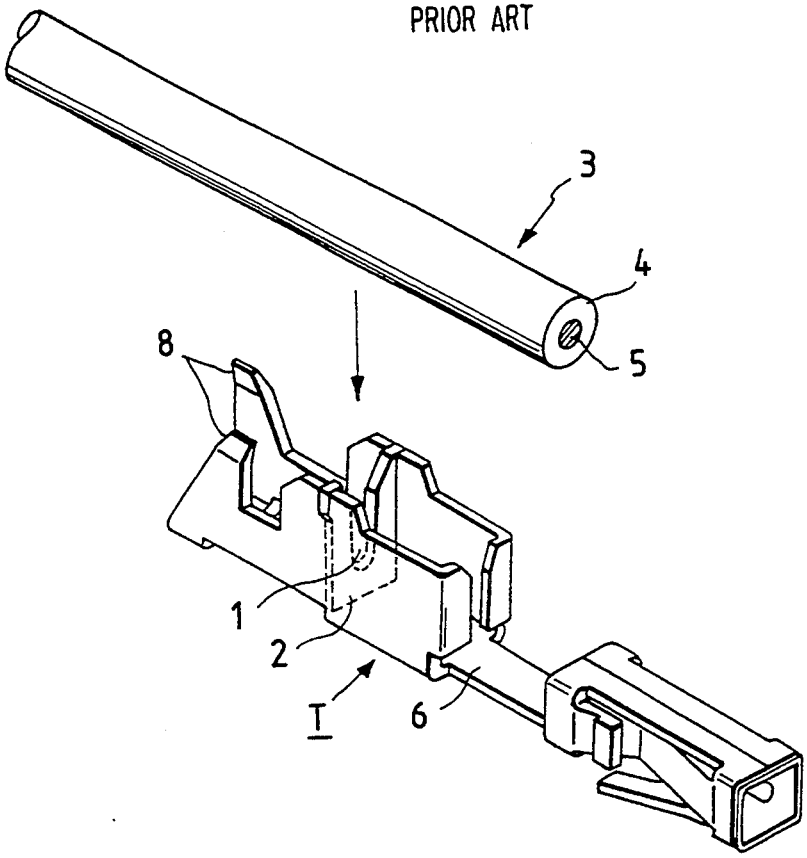
FIG. 8 PRIOR ART
FIG. 8 is a perspective view of an important portion showing the construction of a conventional press-connecting terminal.
Figure 9:
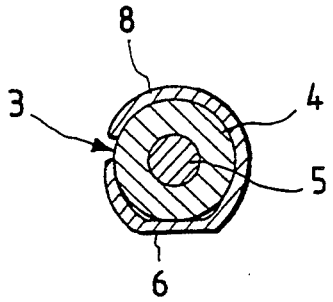
FIG. 9 PRIOR ART
FIG. 9 is a cross-sectional view of an important portion, showing the connection between the press-connecting terminal and a wire.
Figure 10:
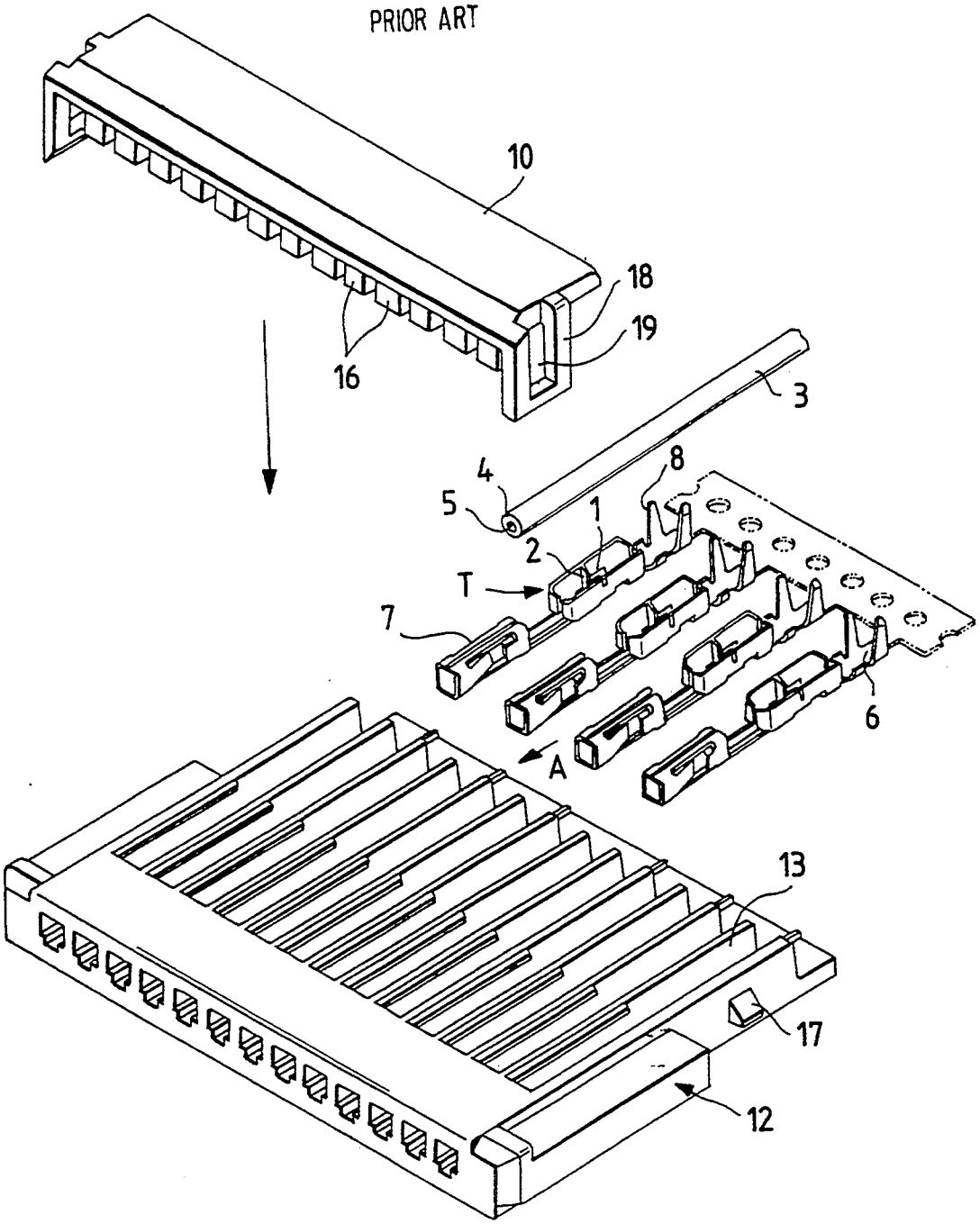
FIG. 10 PRIOR ART
FIG. 10 is an exploded perspective view showing the structure of a conventional connector.
Figure 11:
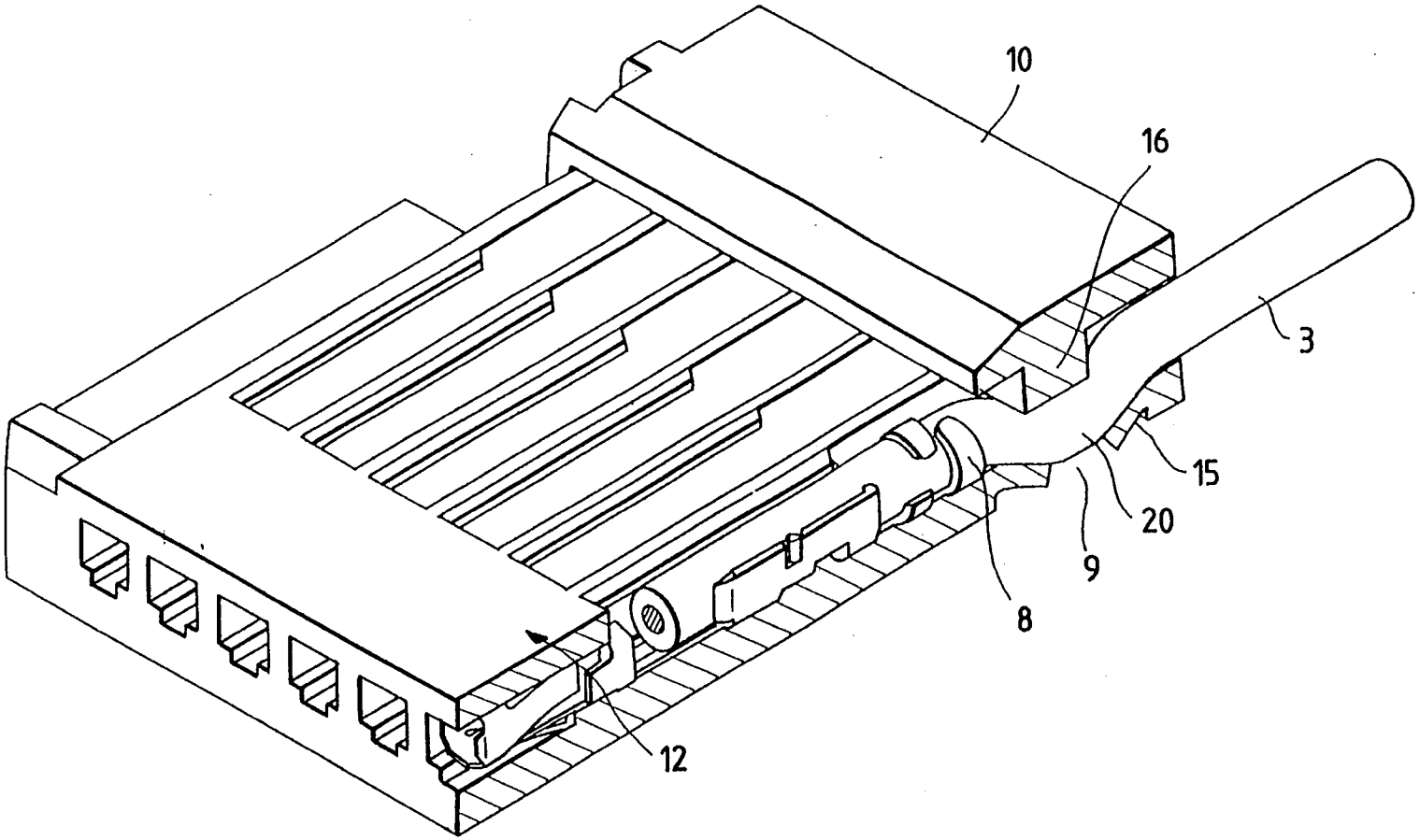
FIG. 11 PRIOR ART
FIG. 11 is a partly-broken, perspective view showing the structure of the conventional connector.

Next, a second embodiment of the present invention will now be described with reference to FIG. 7.

A feature of this; embodiment is that a multi-stage connector is constituted using the above-mentioned housings 31.

The multi-stage connector TC is constituted by inserting connectors C, each including one housing 31, into a receiving box 51, and each connector C has the same construction as described in the first embodiment.

The receiving box 51 is of a one-piece molded construction made of a synthetic resin, and includes a frame 52 in which receiving portions 54 for respectively receiving the connectors C are formed, the receiving portions 54 being separated from one another by partition plates 53. Resilient retaining portions 55 are formed respectively on right and left inner wall surfaces of each receiving portion 54.

The retaining portions 55 are engaged respectively in recesses 36*a* formed respectively in outer side walls of the housing 31, thereby preventing the connector C from being withdrawn. The recess 36*a* is in communication with an opening 36. A resilient retaining portion 56 is formed on an upper surface of the receiving box 51, and when the multi-stage connector TC is connected to a mating connector, the resilient retaining portion 56 is resiliently deformed to be lockingly engaged with the mating connector.

As described above for the first embodiment, each connector C is constructed into a compact size without the use of any member attached to the outer side of the connector. Therefore, an internal space of each receiving portion 54 may be narrow, and the receiving box 51 can also be of a compact size. The multi-stage connector TC is assembled by inserting the connectors C into the respective receiving portions 54 from a direction indicated by arrow A. Since the connector C to be thus received is of a compact size, the receiving portion 54 and hence the overall construction of the receiving box 51 can be of a compact size, and therefore it is easily handled.

Although the embodiments of the present invention have been described above, the present invention is not limited to the above embodiments, and various modifications can be made. For example, the resilient pieces 41 constituting the holder member 37 is not limited to the arrangement in which they project respectively from the opposed sides, and instead the holder member may be constituted by one resilient member projecting from one side as at the opposite side portions of the connector as shown in FIG. 2(*b*). In this case, the amount of projecting is so adjusted that the wire 3 may not lift upward past the resilient member. Taking into consideration the withdrawal of the press-connecting terminal T at the time of maintenance, the step portion 41*b* may be slanting as shown in FIG. 2(*c*).

As described above, in the connector of the present invention, the openings are formed in the housing receiving the press-connecting terminals each having the wire compressively clamped thereto, and the holder members, which hold the wire in such a manner that the wire is bulged into the opening, are formed integrally with the housing.

Therefore, even when an external force acts on the wire bulged into the opening by the holder members, the wire will not be easily withdrawn, and therefore an imperfect connection will not develop between the wire and the press-connecting terminal. And besides, since the holder members are formed integrally with the housing, any member to be attached to the outer side of the housing so as to hold the wire does not need to be used, and the number of the component parts as well as the operation manday can be reduced, and the connector can be of a compact size.

What is claimed is:

1. A connector comprising:

a housing having a terminal receiving chamber provided therein for receiving a terminal having a wire secured thereto, said terminal receiving chamber being defined by partition walls on opposite sides thereof and a bottom wall, said bottom wall having an opening therein; and a resilient holding member extending from one of said partition walls so as to at least partially cover said opening, wherein said holding member urges the wire into said opening so as to partially bend said wire to thereby resist any external pulling forces applied to said wire.

2. The connector of claim 1 wherein said housing includes a plurality of said terminal receiving chambers and a corresponding number of holding members.

3. The connector of claim 2, wherein said housing includes a pair of said holding members for each of said plurality of terminal receiving chambers.

4. The connector of claim 1, wherein said opening is formed across the entire terminal receiving chamber.

5. The connector of claim 1, wherein said resilient holding member extends from said one partition wall in a cantilevered manner.

6. The connector of claim 1, further comprising a resilient retaining member for retaining the terminal in said terminal receiving chamber, said retaining member being disposed at a center of said terminal receiving chamber.

7. The connector of claim 6, wherein said housing includes a plurality of said terminal receiving chambers and a corresponding number of holding members and retaining members.

8. The connector of claim 7, wherein said housing includes a pair of said holding members for each of said plurality of terminal receiving chambers.

9. The connector of claim 1, further comprising a receiving box having a receiving port for receiving said housing.

10. The connector of claim 9, wherein said receiving box has a plurality of said receiving ports for respectively receiving a plurality of said housings.

11. The connector of claim 9, wherein said receiving box includes resilient retaining members on opposite inner wall surfaces of said receiving port which respectively engage openings formed in said housing.

* * * * *